US007459678B2

(12) United States Patent
Schoen

(10) Patent No.: US 7,459,678 B2
(45) Date of Patent: Dec. 2, 2008

(54) SWITCHABLE BRANCHED ION GUIDE

(75) Inventor: Alan E. Schoen, Saratoga, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 11/542,076

(22) Filed: Oct. 2, 2006

(65) Prior Publication Data

US 2008/0073515 A1 Mar. 27, 2008

Related U.S. Application Data

(60) Provisional application No. 60/799,813, filed on May 12, 2006.

(51) Int. Cl.
*H01J 49/42* (2006.01)
*H01J 49/00* (2006.01)

(52) U.S. Cl. ..... 250/292; 250/290; 250/281; 250/288; 250/396 R

(58) Field of Classification Search ..... 250/292, 250/281, 288, 290, 396 R
See application file for complete search history.

(56) References Cited

U.S. PATENT DOCUMENTS 5,825,026 A * 10/1998 Baykut ..... 250/288
6,528,784 B1 * 3/2003 Tang et al. ..... 250/282
6,891,157 B2 * 5/2005 Bateman et al. ..... 250/292
2007/0057178 A1 3/2007 Chernushevich et al.

FOREIGN PATENT DOCUMENTS

WO WO 2004/023516 A1 3/2004

* cited by examiner

*Primary Examiner*—Nikita Wells
(74) *Attorney, Agent, or Firm*—Charles B. Katz; Carr & Ferrell LLP

(57) ABSTRACT

A switchable branched ion guide is disclosed. The switchable branched ion guide includes a trunk section, first and second branch sections, a junction connecting the trunk section to the branch sections, and a movable valve member located at the junction. The valve member may be moved between a first position in which ion travel is permitted between the trunk section and first branch section and is inhibited between the trunk section and the second branch section, and a second position in which ion travel is permitted between the trunk section and the second branch section and is inhibited between the trunk section and the first branch section. The branched ion guide may be utilized, for example, to controllably switch an ion stream between two destinations such as mass analyzers.

22 Claims, 9 Drawing Sheets

SWITCHABLE BRANCHED ION GUIDE

CROSS-REFERENCE TO RELATED APPLICATION

This application claims priority under 35 U.S.C §119(e)(1) to U.S. Provisional Patent Application Ser. No. 60/799,813 by Alan E. Schoen entitled "Switchable Branched Ion Guide", filed on May 12, 2006.

BACKGROUND OF THE INVENTION

1. Field of the Invention

The present invention relates generally to mass spectrometry, and more particularly to quadrupole ion guides for mass spectrometers.

2. Description of Related Art

Quadrupole ion guides are well known in the mass spectrometry art for transport of ions between regions of a mass spectrometer instrument. Generally described, such ion guides consist of two pairs of elongated electrodes to which opposite phases of a radio-frequency voltage are applied. The substantially quadrupolar field thus generated radially confines ions within the ion guide such that ions may be transported without substantial losses along an axial path extending between the entrance and exit ends of the ion guide.

In conventional mass spectrometer instruments, ions are transported along a single path extending between an ion source and at least one mass analyzer. Recently, there has been great interest in the development of mass spectrometer systems having more complex architectures, which may require ions to be selectively switched between two or more alternative pathways. For example, a hybrid mass spectrometer may utilize two different types of mass analyzers arranged in parallel, with ions being controllably directed to a selected one of the two mass analyzers. In another example, ions may be switched between a first pathway in which they enter a collision cell and undergo fragmentation into product ions, and a second pathway on which they remain intact. In yet another example, ions generated in one of two different ion sources are selectively admitted to a mass analyzer.

Successful operation of such mass spectrometer instruments require that ion path switching be performed in a manner that does not result in an unacceptable degree of ion loss, and which is non-mass discriminatory. It is also desirable to switch between the plurality of pathways relatively rapidly. The prior art contains few if any devices capable of satisfying these criteria.

SUMMARY OF THE INVENTION

Roughly described, an embodiment of the present invention takes the form of a switchable branched ion guide including a trunk section, at least first and second branch sections, and a junction connecting the trunk section with the branch sections. The trunk and branch sections may be constructed from two Y-shaped flat electrodes arranged in parallel, and a plurality of side electrodes arranged in planes generally orthogonal to the planes of the Y-shaped electrodes. Opposite phases of a radio-frequency voltage may be applied to the Y-shaped electrodes and to the side electrodes to radially confine ions within the interior volumes of the trunk and branch sections.

A valve member, located at the junction, may be controllably moved between a first position and a second position. When the valve member is moved to the first position, the first branch section is "opened", whereby ions are allowed to move between the interior volumes of the trunk and first branch sections, and the second branch section is "closed", whereby the movement of ions between the trunk and second branch sections is impeded. Similarly, movement of the valve member to the second position closes the first branch section and opens the second branch section. In this manner, the ions are controllably switched between two pathways, the first pathway including the first branch section interior volume and the second pathway including the second branch section interior volume. In certain embodiments, the valve member is operable in at least one intermediate position, whereby ions may move between the trunk section and both the first and second branch sections.

Movement of the valve member may involve a pivoting and/or sliding motion. The valve member may be controllably actuated by piezoelectric, magnetic, electromechanical, pneumatic or other suitable means.

DETAILED DESCRIPTION

Figure 1A:
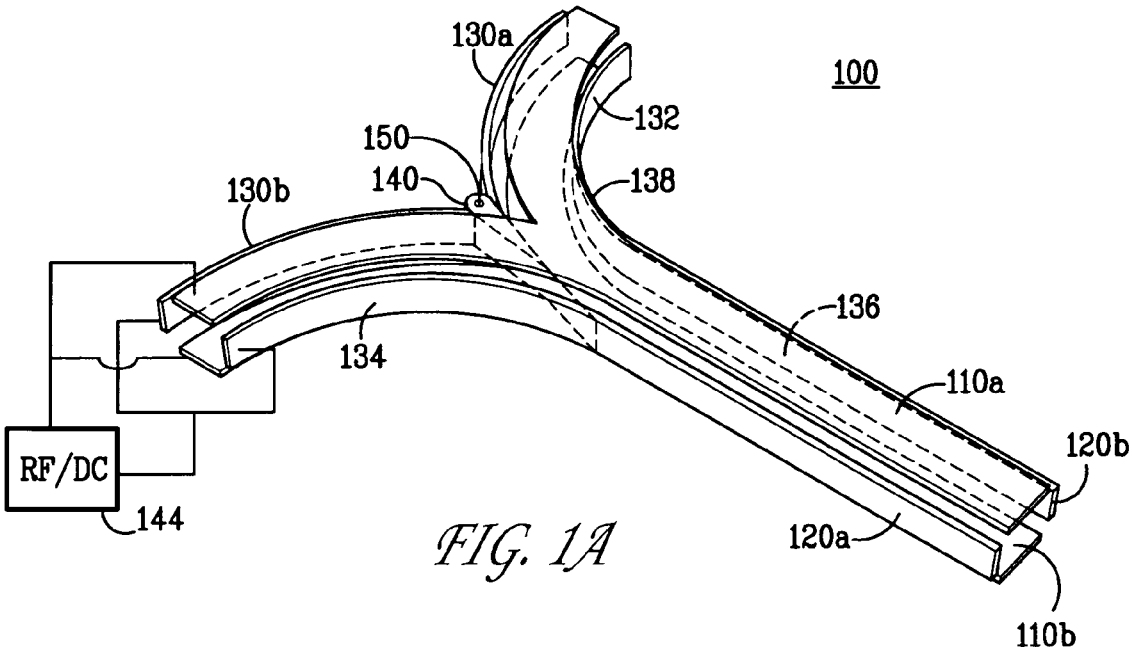
FIG. 1A illustrates a perspective view of a switchable branched ion guide, according to a first embodiment of the invention, wherein a valve member is pivotable between selected positions.

FIG. 1A illustrates a perspective view of a switchable branched ion guide 100 including a valve member 140, according to a first embodiment. The switchable branched ion guide 100 is formed from an upper Y-shaped planar electrode 110*a* and a lower Y-shaped electrode 110*b*, and a plurality of side electrodes 120*a*, 120*b*, 130*a*, and 130*b* that are oriented generally orthogonally with respect to the planes of Y-shaped electrodes 110*a* and 110*b*. The orthogonal and side electrodes collectively define a first branch section 132, a second branch section 134, a trunk section 136, and a junction 138 connecting first and second branch sections 132 and 134 with trunk section 136. While upper and lower planar electrodes 110*a* and 110*b* are depicted as having monolithic structures, other implementations of the branched ion guide may utilize upper and lower electrodes having segmented structures.

As is known in the art, ions may be radially confined within the interior volumes of the branch and trunk sections by application of a suitable radio-frequency (RF) voltage to the various electrodes. More specifically, radial confinement is achieved by applying opposite phases of an RF voltage (supplied, for example, by RF/DC source 144) to Y-shaped electrodes 110*a* and 110*b* and to side electrodes 120*a*, 120*b*, 130*a*, and 130*b*. If desirable, a suitable direct current (DC) component may also be applied to the electrodes to provide mass filtering of the ions, in a manner also known in the art. As is further known in the art, an axial DC field may be generated by the use of auxiliary rods (as disclosed, for example, in U.S. Pat. No. 6,111,250 by Thomson et al.) or other suitable expedient to propel ions axially through ion guide 100. An inert gas, such as helium or nitrogen, may be added to the interior of ion guide 100 to provide kinetic cooling of the ions and to assist in focusing ions to the appropriate axis. If fragmentation of ions is desired, ions may be accelerated to high velocities, either within ion guide 100 or prior to entry to ion guide 100, such that they undergo energetic collisions with atoms or molecules of the buffer gas. Ions may also undergo low velocity interaction with a reactive gas and dissociate into product ions. Fragmentation may also be carried out in one or more collision/reaction cells placed upstream or downstream in the ion path from ion guide 100.

The pathway followed by ions within ion guide 100 is determined by controllably positioning valve member 140. According to the FIG. 1 embodiment, valve member 140 is configured as an elongated arm that is rotatably pivotable about a pivot point 150. The design of valve member 140 may be more easily discerned with reference to FIG. 1B, which depicts ion guide 100 with upper Y-shaped electrode 110*a* removed. While valve member 140 is depicted in the figures as having substantially straight or slightly curved side surfaces, in a preferred implementation of ion guide 100 valve member 140 is provided with opposing arcuate surfaces having curvatures that approximately match the corresponding curvatures of side electrodes 130*a* and 130*b*. Valve member 140 may be formed from an electrically conductive material (e.g., stainless steel) or from an insulator (e.g., ceramic) that is coated with a conductive material. Valve member 140 is placed in electrical communication with the side electrodes, for example by electrical contact with one of the side electrodes or via a separate connection to the RF voltage supply, such that a substantially quadrupolar field is generated that radially confines ions along the selected pathway. Because valve member 140 is preferably configured to minimize field inhomogeneity, the field that an ion experiences is essentially independent of its position along the first or second branch section.

Figure 1B:
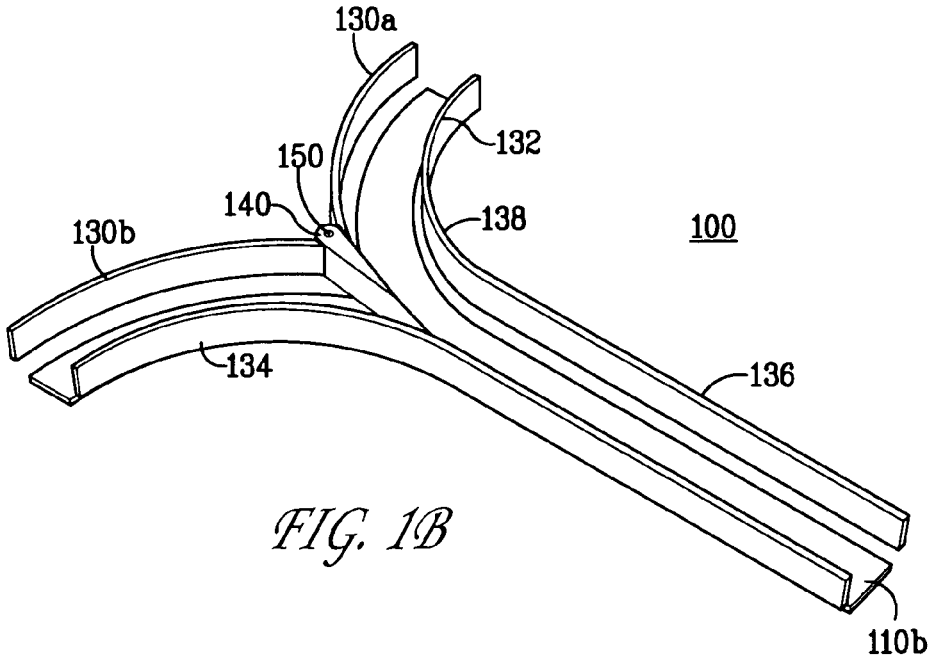
FIG. 1B illustrates a perspective view of the switchable branched ion guide system of FIG. 1A, with an upper Y-shaped electrode removed to more clearly show features of the ion guide.

In FIGS. 1A and 1B, valve member 140 is set in a first position in which ions are permitted to travel between the interior volumes of trunk section 136 and first branch section 132, and are impeded from travel between the interior volumes of trunk section 136 and second branch 134. As will be noted in further detail below, ion guide 100 is inherently bidirectional, and may be configured such that ions travel from the trunk section 136 to a selected one of the branch sections, or alternatively from a selected one of the branch sections to the trunk section 136.

Figure 2A:
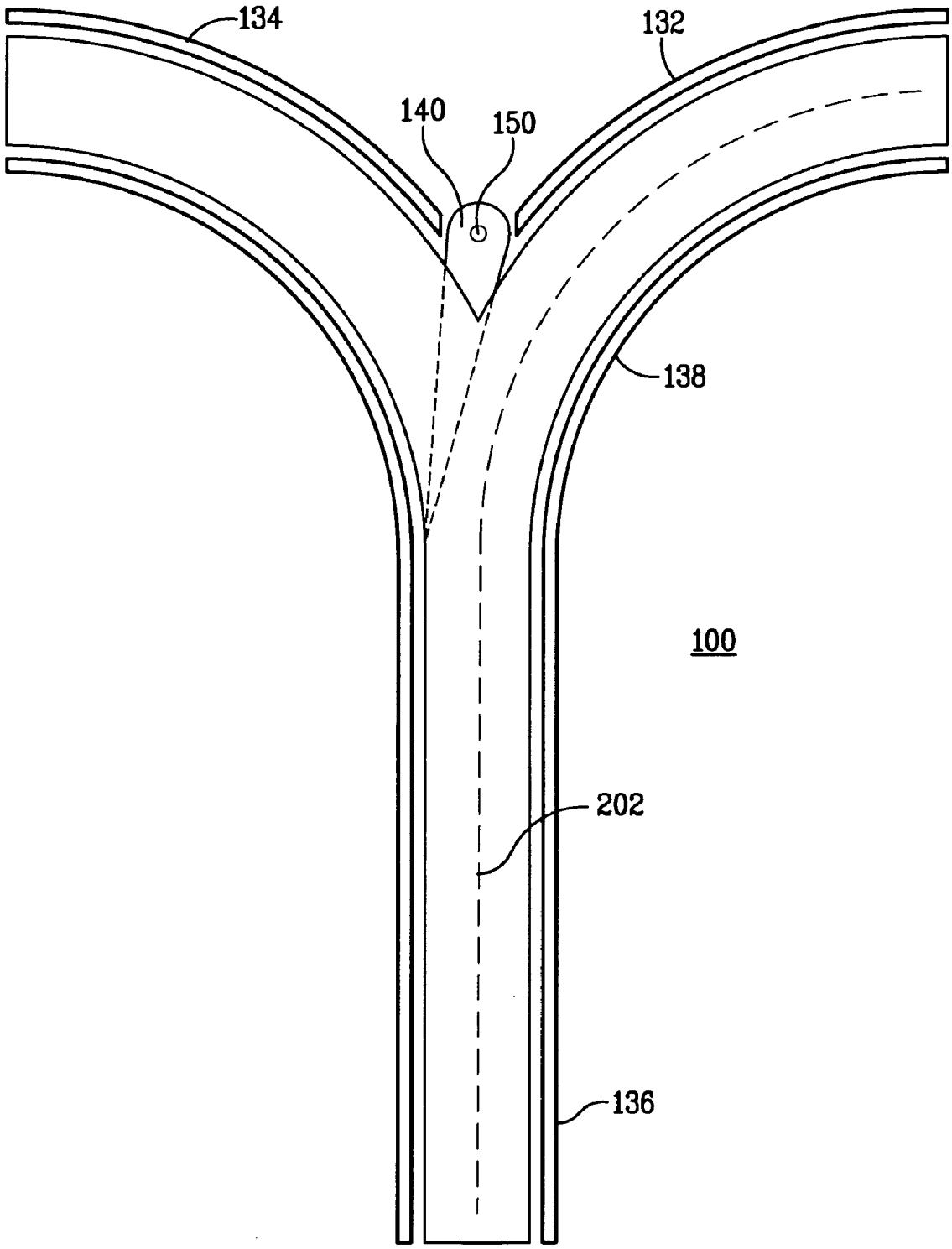
FIG. 2A illustrates a top view of the switchable branched ion guide, with the valve member in a first position.
Figure 2B:
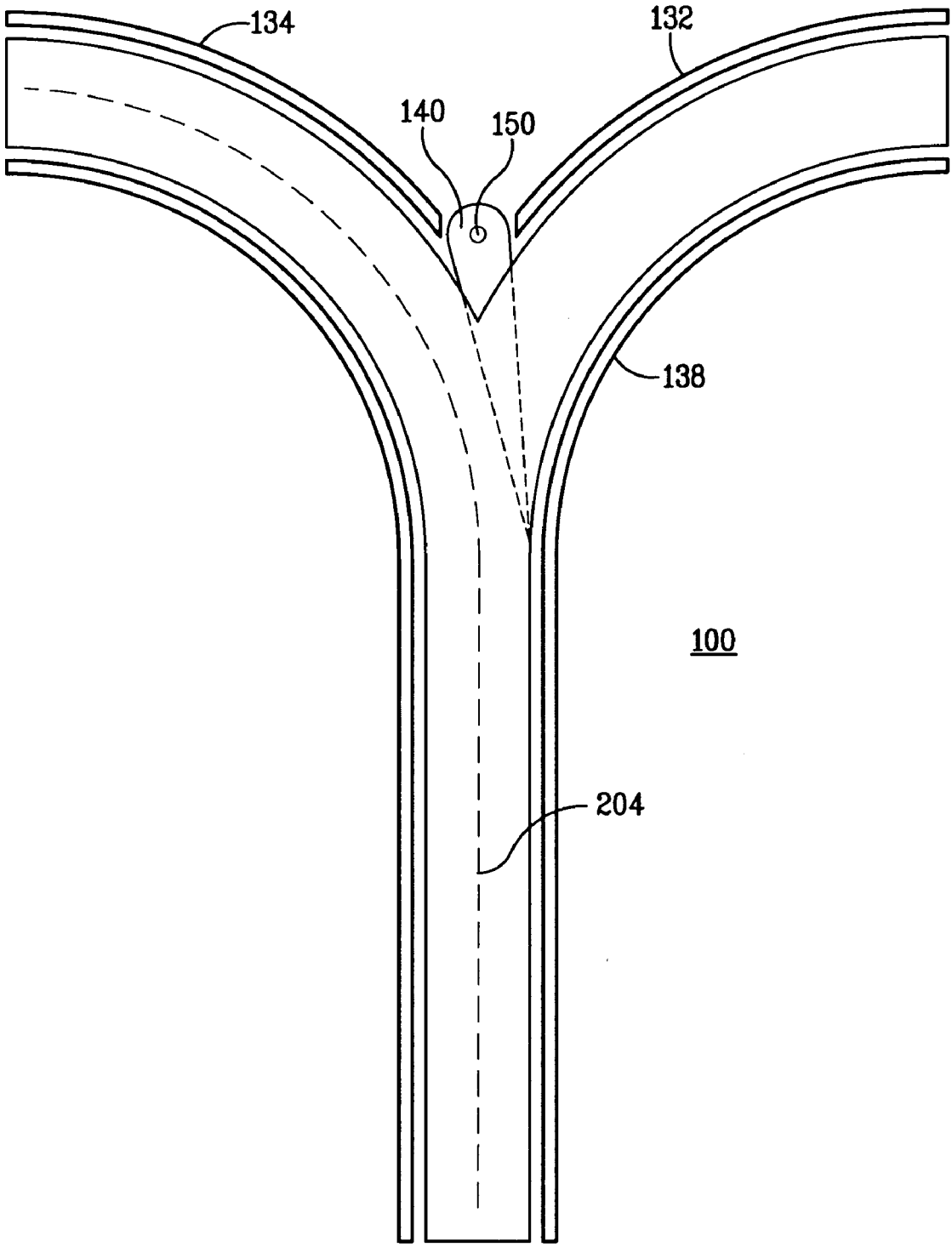
FIG. 2B illustrates a top view of the switchable branched ion guide, with the valve member moved to the second position.

The switching of switched ion guide 100 is illustrated in FIGS. 2A and 2B. In FIG. 2A, valve member 140 is set in the first position discussed above, in which ions are allowed to travel between the interiors of first branch section 132 and trunk section 136 along pathway 202. In FIG. 2B, valve member has been rotated about pivot point 150 to a second position in which ions may travel between the interior volumes of second branch section 134 and trunk section 136 along pathway 204, but are impeded from travel between first branch section 132 and trunk section 136. Movement of valve member 140 between the first and second position may be accomplished by one of variety of mechanisms known in the art, including without limitation electromechanical actuators, piezoelectric actuators, hydraulic actuators, and magnetic actuators. It is generally desirable that switching be performed rapidly and without excessive "bouncing" of the valve member, although the exact switching speed requirements will vary according to specific configurations and applications of the mass spectrometer instrument in which branched ion guide 100 is used.

Figure 2C:
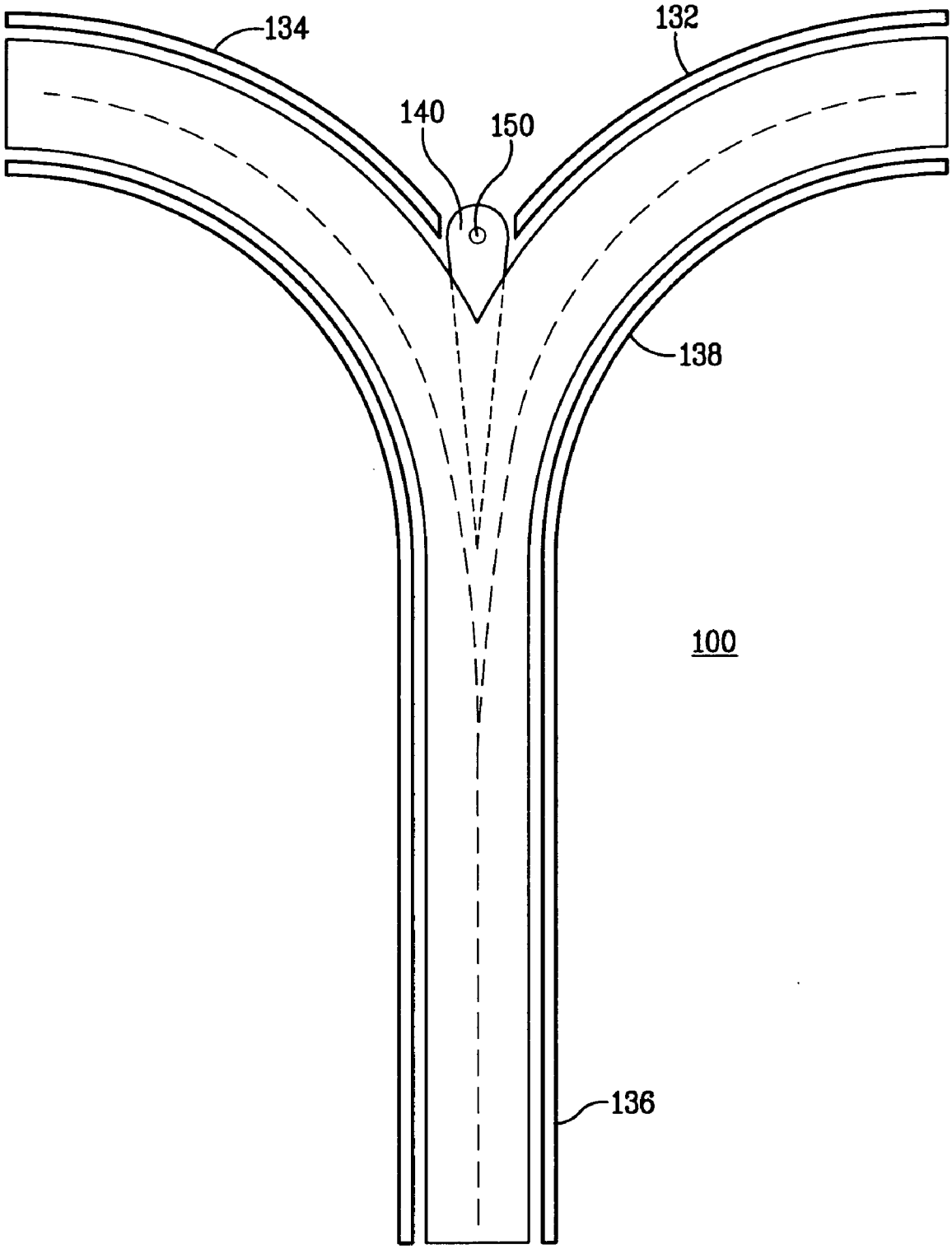
FIG. 2C illustrates a top view of the switchable branched ion guide, with the valve member moved to an intermediate position.

In certain implementations of branched ion guide 100, it may be advantageous to permit positioning of valve member 140 in a third position intermediate the first and second positions. In this intermediate position, which is illustrated in FIG. 2C, ions may travel between the interior volumes of trunk section 136 and both branch sections 132 and 134. This condition may be employed, for example, to combine two ion streams flowing from the branch sections into a single ion stream flowing through the trunk section, or alternatively to split a single ion stream flowing through the trunk section into two ion streams directed through the first and second branch sections. While FIG. 2C depicts the intermediate position as being midway between the first and second position, thereby effecting an equal split between (or equal combination of) ions traveling in the branch sections, it may also or alternatively be desirable to enable positioning of valve member 140 in one or more intermediate positions whereby ions are preferentially (but not exclusively) directed into one of the two branches, i.e., to direct unequal portions of the ion stream traveling through trunk section 136 into first and second branch sections 132 and 134. However, those skilled in the art will recognize that ion transmission may be severely adversely impacted when valve member 140 is placed in the intermediate position due to distortion of the quadrupolar field.

Figure 3A:
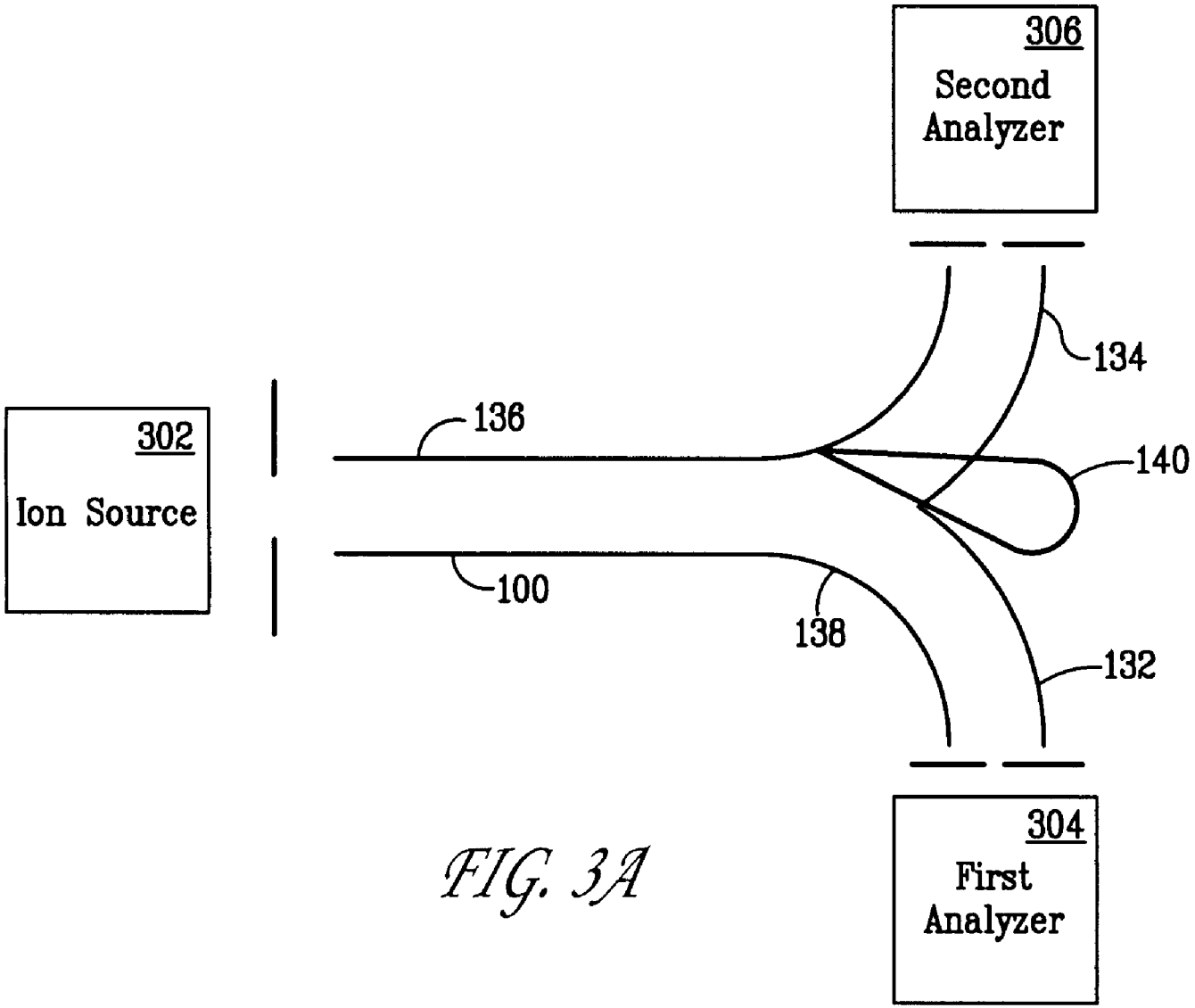
FIG. 3A illustrates a first example of a mass spectrometer instrument architecture employing a switchable branched ion guide.
Figure 3B:
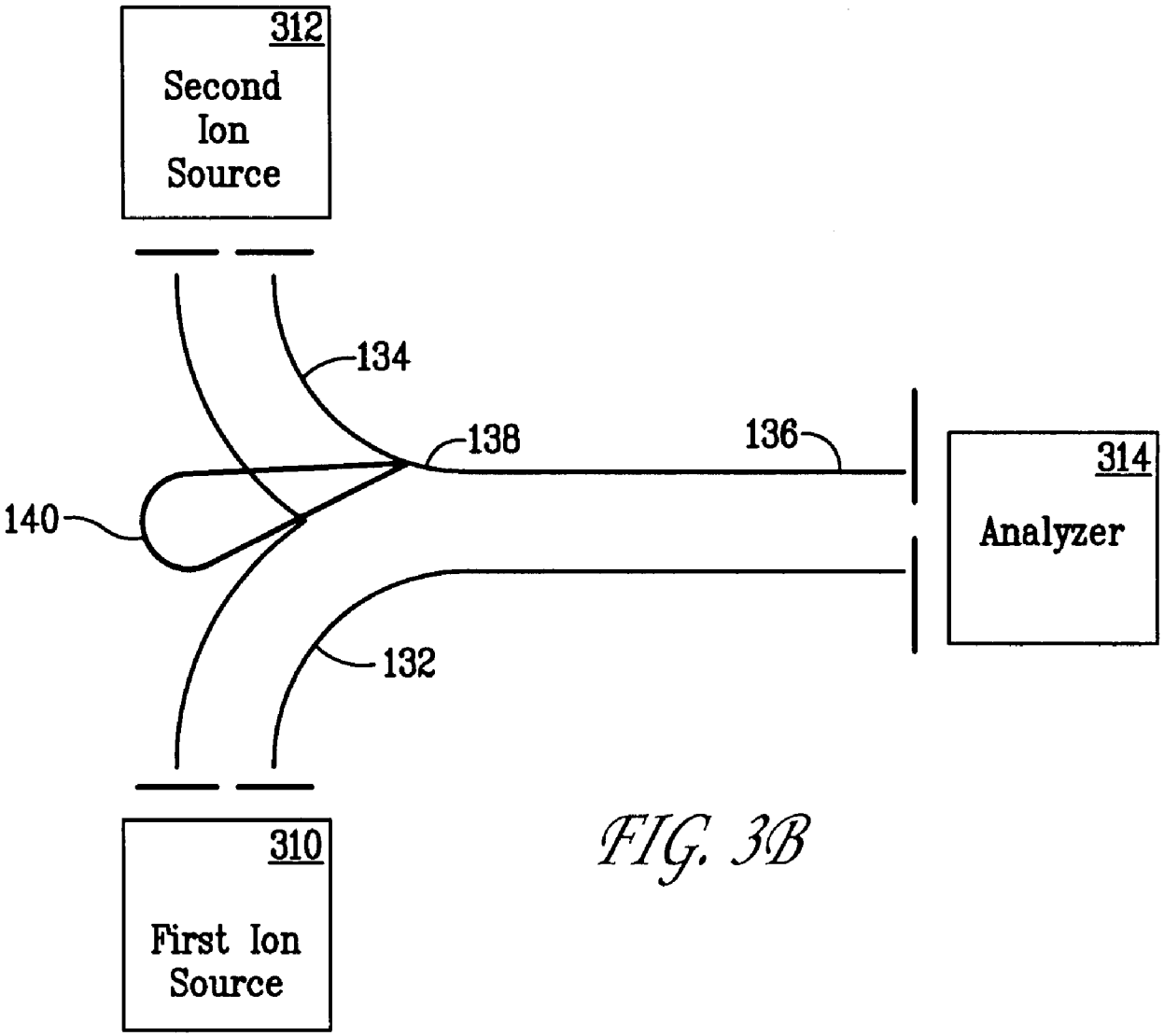
FIG. 3B illustrate a second example of a mass spectrometer instrument architecture employing a switchable branched ion guide.

FIGS. 3A and 3B illustrate two examples of mass spectrometer instrument architectures utilizing branched ion guide 100. In the first example shown in FIG. 3A, branched ion guide 100 is employed to controllably direct an ion stream generated by ion source 302 to a selected one of (or both of) mass analyzers 304 and 306. Ions generated in ion source 302 (which may take the form, for example, of a continuous ion source such as an electrospray or atmospheric pressure chemical ionization source, or a pulsed source such as a matrix-assisted laser desorption ionization (MALDI) source) flow into an end of trunk section 136 and travel toward junction 138. Depending on the position of valve member, the ions pass into the interior volume of either first branch section 132 or second branch section 134 (or both, if valve member 140 is set in an intermediate position.) FIG. 3A depicts valve member 140 set in the first position, whereby ions are directed into first branch section 132. Ions directed into first branch section 132 travel to first mass analyzer 304, where the mass-to-charge ratios of the ions (or their products) are determined. Similarly, ions directed into second branch section 134 travel to second mass analyzer 306 for determination of their mass-to-charge ratios (or the mass-to-charge ratios of their products). First and second mass analyzers 302 and 304 may be of the same or different type, and may comprise any one or a combination of mass analyzers known in the art, including without limitation quadrupole ion traps, quadrupole mass filters, electrostatic ion traps, time-of-flight analyzers, magnetic sector analyzers, and Fourier transform/ion cyclotron resonance (FTICR) analyzers.

FIG. 3B depicts a second example of an instrument architecture, in which ion guide 100 is configured in a reversed orientation relative to the FIG. 3A example, whereby ions flow from the interior volume of a selected one of the branch sections into the interior volume of trunk section 136. In this example, ion guide 100 is employed to controllably direct an ion stream generated by the selected one of first and second ion sources 310 and 312 into trunk section 136 and thereafter into mass analyzer 314. Ion sources 310 and 312 may take the form of any one or a combination of ion sources known in the art (including without limitation those ion sources set forth above) and may be of the same or different types. The position of valve member 140 determines which ion stream is admitted into trunk section 136. FIG. 3B depicts valve member 140 set in the first position, whereby ions are directed from first ion source 310 through first branch section 132 and into trunk section 136. When valve member 140 is moved to the second position, ions travel from second ion source 312 through second branch section 134 into trunk section 136. If valve member 312 is also positionable in a third, intermediate position, then ions may travel from both branch sections into trunk section 136. Ions entering trunk section 136 may traverse the length of the trunk section and enter a mass analyzer 314 (which may be of any suitable type, including those discussed above) for determination of the mass-to-charge ratio of the ions and/or their fragmentation products.

It should be understood that the instrument architectures depicted in FIGS. 3A and 3B are intended only as illustrative examples of environments in which a switchable branched ion guide may be utilized, and should not be considered to limit the branched ion guide to any particular application. Those skilled in the art will also recognize that two or more switchable branched ion guides of the type described above may be combined in series to provide switching among three or more ion pathways.

Figure 4A:
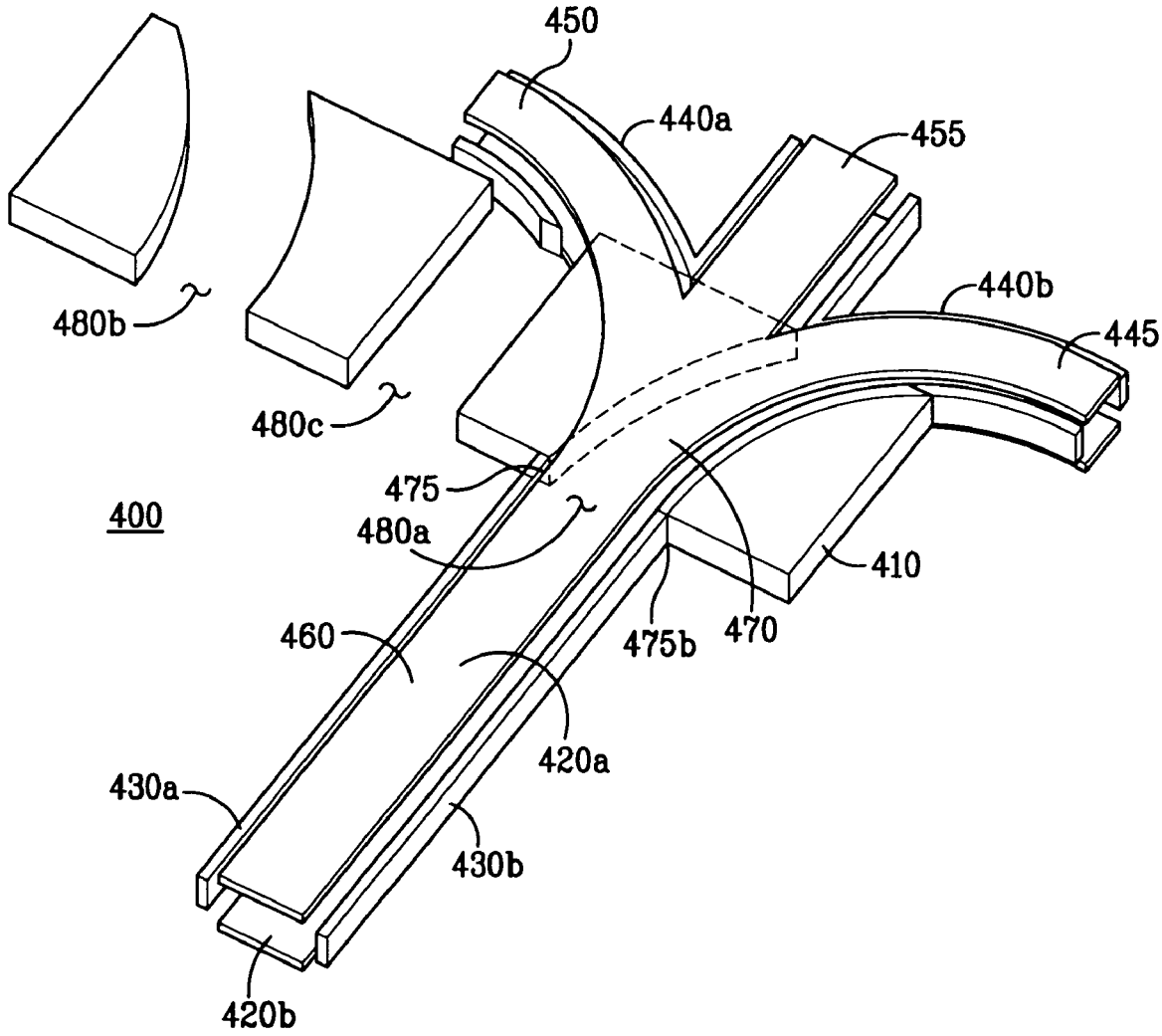
FIG. 4A illustrates a perspective view of a switchable branched ion guide according to a second embodiment of the invention, wherein the valve member is slidably movable between selected positions, the valve member being at a first position.
Figure 4B:
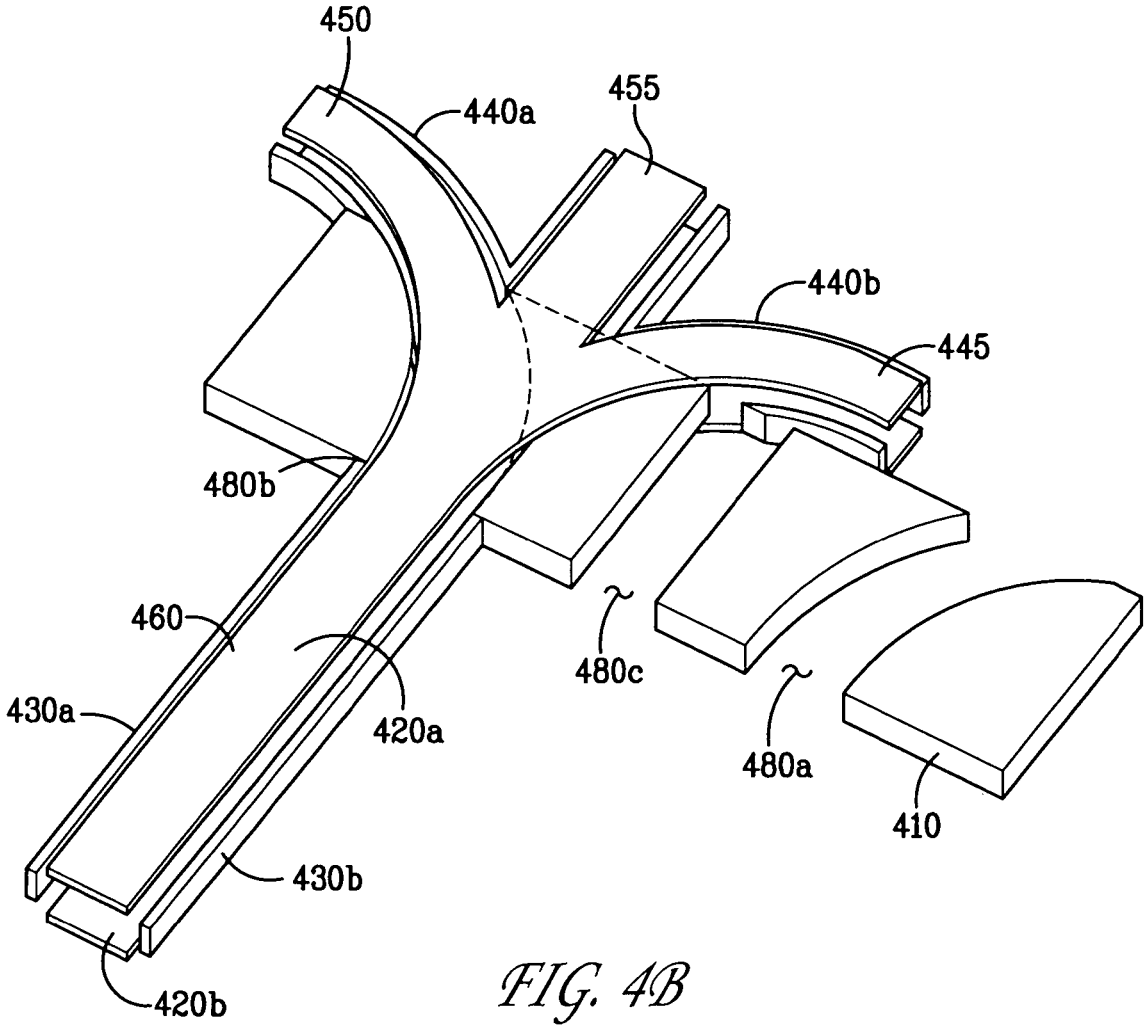
FIG. 4B illustrates a perspective view of the switchable branched ion guide of FIG. 4A, wherein the valve member has been moved to a second position.
Figure 4C:
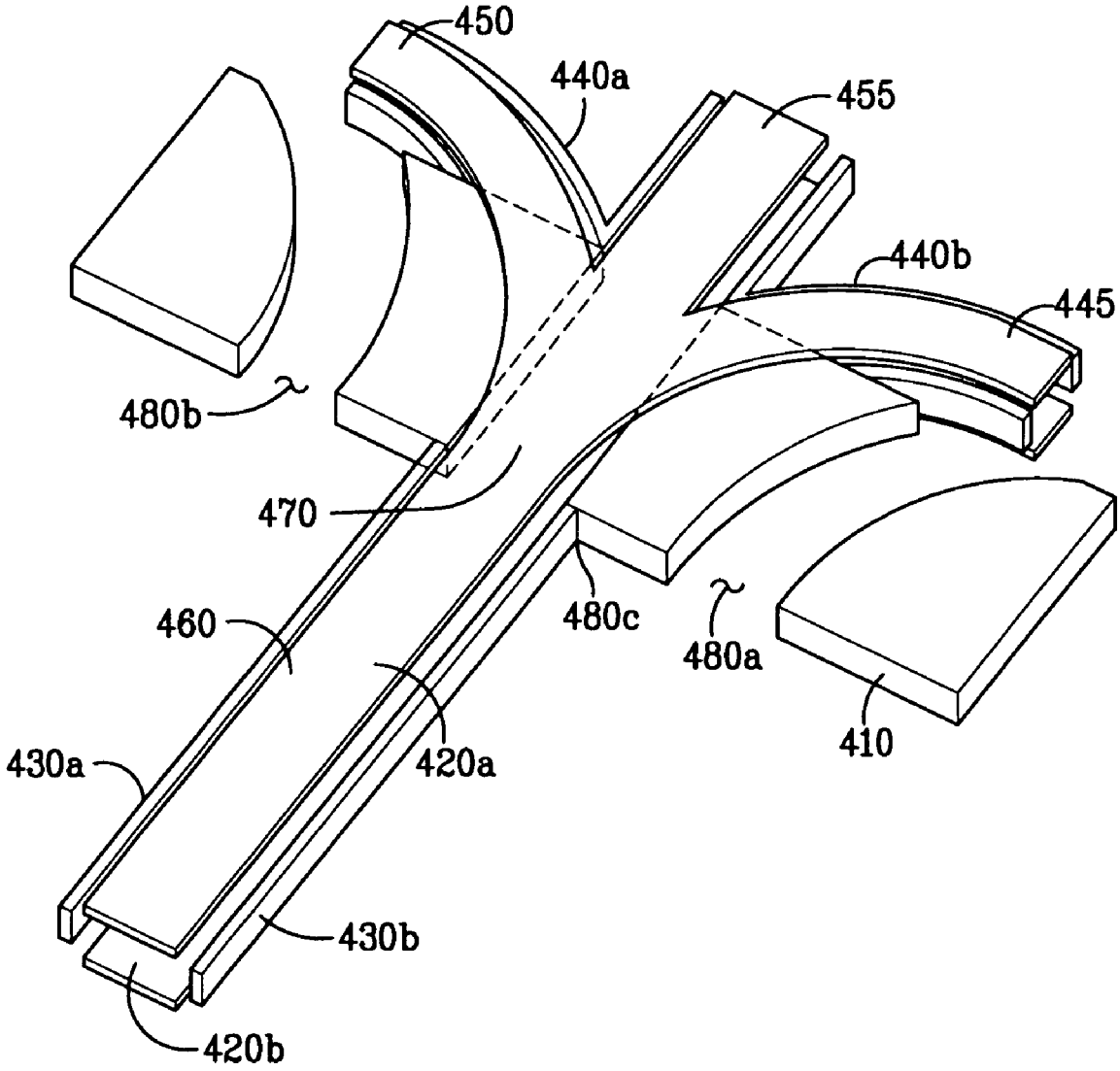
FIG. 4C illustrates a perspective view of the switchable branched ion guide of FIG. 4A, wherein the valve member has been moved to a third position.

FIGS. 4A-4C illustrates a second embodiment of a switchable branched ion guide 400, having a slidably positionable valve member 410. Branched ion guide 400 includes planar spaced-apart upper and lower trifurcated electrodes 420*a* and 420*b*, and side electrodes 430*a*, 430*b*, 440*a* and 440*b* oriented generally orthogonally with respect to upper and lower electrodes 420*a* and 420*b*. Collectively, the upper and lower electrodes and side electrodes define first, second and third branch sections 445, 450 and 455, trunk section 460, and junction 470 connecting the trunk section to the branch sections. Again, as known in the art, opposite phases of a radio-frequency voltage are applied to the upper/lower and side electrode pairs to generate a substantially quadrupolar field that radially confines ions to the interior volumes of the various sections.

Switching of branched ion guide 400 is accomplished by controllably sliding valve member 410 in a direction generally transverse to the direction of ion travel. Side electrodes 430*a* and 430*b* are adapted with openings 475*a* and 475*b* through which the ends of valve member 410 project to permit its sliding movement. Valve member 410 may be implemented as a block having a set of channels 480*a*, 480*b* and 480*c* formed therein. While not shown in the figures, the channels will be laterally bridged by one or more connecting members that provide structural integrity to valve member 410, preferably without substantially impeding ion flow. For example, each channel may be bridged by a set of upper and lower U-shaped connecting members having ends respectively secured to the upper and lower surfaces of valve member 410. Channels 480*a*, 480*b* and 480*c* each have substantially constant cross-sectional areas and have edge surfaces shaped to match the curvature of the electrodes defining a corresponding branch section: channel 480*a* matches first branch section 445, channel 480*b* matches second branch section 450, and channel 480*c* matches third branch section 455. Valve member 410 is placed in electrical communication with the side electrodes, for example by electrical contact with one of the side electrodes or via a via a separate connection to the RF voltage supply, such that a substantially quadrupolar field is generated that radially confines ions along the selected pathway. Because valve member 410 is configured to minimize field inhomogeneity, the field that an ion experiences is essentially independent of its position along the first, second or third branch section.

The pathway followed by ions within ion guide 400 is determined by the position of valve member 410. FIGS. 4A, 4B and 4C respectively depict valve member 410 in its first, second and third positions. In the first position, ion travel is permitted between the interior volumes of trunk section 460 and first branch section 445 and blocked (by the presence of solid surfaces) between the interior volumes of trunk section 460 and second and third branch sections 450 and 455. When valve member is moved to the second position, depicted in FIG. 4B, ion travel is permitted between the interior volumes of trunk section 460 and second branch section 450 and blocked between the interior volumes of trunk section 460 and first and third branch sections 445 and 455. Finally, when valve member is moved to the third position, depicted in FIG. 4C, ion travel is permitted between the interior volumes of trunk section 460 and third branch section 455 and blocked between the interior volumes of trunk section 460 and first and third branch sections 445 and 450. Movement of valve member 410 between positions may be accomplished by one of variety of mechanisms known in the art, including without limitation electromechanical actuators, piezoelectric actuators, hydraulic actuators, and magnetic actuators.

The embodiments discussed herein are illustrative of the present invention. As these embodiments of the present invention are described with reference to illustrations, various modifications or adaptations of the methods and/or specific structures described may become apparent to those skilled in the art. All such modifications, adaptations, or variations that rely upon the teachings of the present invention, and through which those teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A switchable branched ion guide, comprising:

a trunk section, a first branch section, a second branch section, and a junction connecting the trunk section with the first and second branch sections, each of the trunk section and the first and second branch sections including at least two electrode pairs to which opposite phases of a radio frequency voltage are applied; and a valve member positioned at the junction, the valve member being movable between a first position that allows ion travel between interior volumes of the trunk and first branch sections and impedes ion travel between interior volumes of the trunk and second branch sections, and a second position that allows ion travel between interior volumes of the trunk and second branch sections and impedes ion travel between interior volumes of the trunk and first branch sections.

2. The ion guide of claim 1, wherein the valve member includes an arm rotatable about a pivot point.

3. The ion guide of claim 1, wherein the valve member includes a slidable block having multiple channels.

4. The ion guide of claim 1, wherein ions pass from the interior volume of the trunk section to the interior volume of a selected one of the first and second branch sections.

5. The ion guide of claim 1, wherein ions pass from the interior volume of a selected one of the first and second branch sections to the interior volume of the trunk section.

6. The ion guide of claim 1, wherein the valve member is movable to a third position that allows ion travel between the interior volume of the trunk section and the interior volumes of both the first and second branch sections.

7. The ion guide of claim 1, wherein the first and second branch sections, trunk section and junction are defined by first and second Y-shaped planar electrodes arranged in generally parallel, spaced apart relation, and a plurality of planar side electrodes oriented generally orthogonally with respect to the Y-shaped electrodes.

8. The ion guide of claim 7, wherein the valve member includes an arm rotatable about a pivot point, the arm having opposed arcuate surfaces having curvatures substantially matching the corresponding side electrodes.

9. The ion guide of claim 1, wherein the valve member is controllably positioned by an electromechanical actuator.

10. The ion guide of claim 1, further comprising a third branch section, and wherein the valve member may be moved to a third position permitting ion travel between the trunk section and the third branch section.

11. The ion guide of claim 1, wherein an inert or reactive gas is added to the interior volumes of the ion guide to provide cooling or fragmentation of the ions.

12. The ion guide of claim 1, further comprising means for generating an axial DC field to assist in propelling ions through the ion guide.

13. A mass spectrometer system, comprising:

an ion source;

a switchable branched ion guide having a trunk section configured to receive ions from the ion source, the ion guide further comprising a first branch section, a second branch section, and a junction connecting the trunk section with the first and second branch sections, each of the trunk section and the first and second branch sections including at least two electrode pairs to which opposite phases of a radio frequency voltage are applied;

a valve member positioned at the junction, the valve member being movable between a first position that allows ion travel from the interior volume of the trunk section to the interior volume of the first branch sections and impedes ion travel from the interior volume of the trunk section to the interior volume of the second branch section, and a second position that allows ion travel from the interior volume of the trunk section to the interior volume of the second branch section and impedes ion travel from the interior volume of the trunk section to the interior volume of the first branch section; and first and second mass analyzers configured to respectively receive ions from the first and second branch sections.

14. The mass spectrometer system of claim 13, wherein the first and second mass analyzers are of different types.

15. The mass spectrometer system of claim 13, wherein the valve member includes an arm rotatable about a pivot point.

16. The mass spectrometer system of claim 13, wherein the first and second branch sections, trunk section and junction are defined by first and second Y-shaped planar electrodes arranged in generally parallel, spaced apart relation, and a plurality of planar side electrodes oriented generally orthogonally with respect to the Y-shaped electrodes.

17. The mass spectrometer system of claim 13, wherein the valve member is movable to a third position that allows ion travel from the interior volume of the trunk section to the interior volumes of both the first and second branch sections.

18. A mass spectrometer system, comprising:

first and second ion sources;

a switchable branched ion guide having first and second branch sections respectively configured to receive ions from the first and second ion sources, the ion guide further comprising a trunk section and a junction connecting the trunk section with the first and second branch sections, each of the trunk section and the first and second branch sections including at least two electrode pairs to which opposite phases of a radio frequency voltage are applied;

a valve member positioned at the junction, the valve member being movable between a first position that allows ion travel from the interior volume of the first branch section to the interior volume of the trunk section and impedes ion travel from the interior volume of the second branch section to the interior volume of the trunk section, and a second position that allows ion travel from the interior volume of the second branch section to the interior volume of the trunk section and impedes ion travel from the interior volume of the first branch section to the interior volume of the trunk section; and a mass analyzer configured to receive ions from the trunk section.

19. The mass spectrometer system of claim 18, wherein the first and second ion sources are of different types.

20. The mass spectrometer system of claim 18, wherein the valve member includes an arm rotatable about a pivot point.

21. The mass spectrometer system of claim 18, wherein the first and second branch sections, trunk section and junction are defined by first and second Y-shaped planar electrodes arranged in generally parallel, spaced apart relation, and a plurality of planar side electrodes oriented generally orthogonally with respect to the Y-shaped electrodes.

22. The mass spectrometer system of claim 18, wherein the valve member is movable to a third position that allows ion travel from the interior volumes of both the first and second branch sections to the interior volume of the trunk section.

* * * * *